US005625954A

United States Patent [19]

DePaoli

[11] Patent Number: 5,625,954

[45] Date of Patent: May 6, 1997

[54] REFLEX LUMINOUS DOT SIGHTING INSTRUMENT WITH ELEVATION AND WINDAGE CONTROLS

[76] Inventor: Alfred C. DePaoli, 1 Wyman St., Woburn, Mass. 01801

[21] Appl. No.: 533,587

[22] Filed: Sep. 25, 1995

Related U.S. Application Data

[63] Continuation of Ser. No. 158,522, Nov. 29, 1993, abandoned.

[51] Int. Cl.[6] ..... F41G 1/32

[52] U.S. Cl. ..... 33/241; 33/248; 33/257

[58] Field of Search ..... 33/247, 248, 241, 33/257, 258, 259, 260; 42/101; 356/251, 252

[56] References Cited

U.S. PATENT DOCUMENTS

| | | | |
|---|---|---|---|
| 834,785 | 10/1906 | Wilkinson | 33/247 |
| 1,756,603 | 4/1930 | Noske | 33/247 |
| 2,237,395 | 4/1941 | Sweet | 33/248 |
| 2,774,142 | 12/1956 | Lake et al. | 33/247 |
| 2,854,748 | 10/1958 | Williams | 33/248 |
| 3,276,127 | 10/1966 | Abrahamson | 33/247 |
| 3,414,221 | 12/1968 | Nelson | 33/247 |
| 3,922,794 | 12/1975 | Ackerman, Jr. | 33/248 |
| 4,085,511 | 4/1978 | Kovac | 33/248 |
| 4,742,636 | 5/1988 | Swan | 33/248 |
| 4,940,324 | 7/1990 | Nichols | 356/251 |

FOREIGN PATENT DOCUMENTS

| | | | |
|---|---|---|---|
| 930125 | 7/1963 | United Kingdom | 33/248 |

*Primary Examiner*—Thomas B. Will
*Attorney, Agent, or Firm*—Robert T. Dunn, Esq.

[57] ABSTRACT

A sighting instrument includes a sighting tube mounted on a base, which is attached to a rifle for sighting the rifle by the user with his eye positioned along the optical axis of the instrument and elevation and windage adjustment controls rotate the tube with respect to the rifle about axes transverse to the rifle, one horizontal at the front of the instrument for elevation adjustment and the other vertical at the rear of the instrument for windage adjustment, the elevation adjustment control being at the rear of the instrument and providing the windage axis, the windage adjustment control being at the front of the instrument and providing the elevation axis and both controls: are carried by the base, are flexibly connected to the tube and can be manipulated readily by finger without a tool; and are readily accessible by the user's while the user is sighting the rifle.

8 Claims, 2 Drawing Sheets

VIEW AA

VIEW EE

VIEW DD

VIEW BB

VIEW CC

REFLEX LUMINOUS DOT SIGHTING INSTRUMENT WITH ELEVATION AND WINDAGE CONTROLS

This is a Continuation of application Ser. No. 08/158,522, filed Nov. 29, 1993 now abandoned.

BACKGROUND OF THE INVENTION

This invention relates to luminous dot sighting instruments and more particularly to such instruments used in connection with a telescope on a firearm as an aid to sighting the firearm on a target.

Optical sighting instruments having a sighting tube have included cross hairs in the tube to define the optical center of the instrument. The user, such as a firearm marksman, looks into the sight and places the cross hairs on the target in the view to aim the firearm. The cross hairs are illuminated by light from the view. At twilight, in haze or fog and at other times when visibility is low, the cross hairs are difficult to see, and at night they cannot be seen at all. One solution to this problem has been the luminous dot sighting instrument.

A luminous dot sighting instrument is used to view a target and is usually attached to a rifle or other firearm to sight the rifle on the target. The luminous dot is generated inside the instrument and is superimposed on the view of the target by a transparent mirror in the instrument. The mirror is transparent to light from the target scene and reflects light from the luminous dot. In this way the luminous dot is superimposed on the target scene as viewed through the instrument and serves the purpose of the cross hairs. Thus, this type of sighting instrument is called a reflex luminous dot sighting instrument. The dot does not depend on light from the view and can be made as bright as desired by the user by controlling the brightness of the luminous dot source.

The instrument is often a sighting tube containing the transparent mirror (window/mirror) and the luminous dot source is a light emitting diode (LED) inside the tube. With the sighting tube are also a battery, brightness control circuit and switch for the LED, usually fixedly attached to the tube. Or the sighting instrument may be a telescope, in which case the LED is inside the telescope and the battery, control circuit and switch are carried on the outside of the telescope as part thereof. In either case, the instrument is attached to a rifle to aid the user in pointing the rifle to hit the target viewed through the instrument.

In such reflex luminous dot sighting instruments, with or without a telescope, the LED is contained in the instrument wherein light is projected from the LED onto a tilted window/mirror that has a mirror coating so that light from the view passing through the lens is joined by light from the diode that reflects from the mirror coating. The user looking into the instrument attached to his rifle sees the target view with the luminous dot at the center and points the rifle to place the dot on the target in the view and fires the rifle. With a properly mounted and adjusted sighting instrument the user can quickly view the target area, put the dot on the target and fire the rifle with great accuracy.

Heretofore, a number of reflex type luminous dot sighting instruments, some with telescopes and some without, have been used with adjustments for range and windage to be made by the firearm user. The adjustments for range and windage are adjustments in elevation angle and azimuth angle, respectively, of the instrument with respect to the firearm and are set by the user using his estimates of range and windage. In all of these, the target view and the luminous dot are combined by the tilted window/mirror or lens/mirror with a mirror coating and light from the target view passes through the tilted lens while light from the LED that forms the luminous dot reflects from the lens mirror coating. Also, in all of these, the LED is contained within the sighting tube or telescope and is powered by a battery in circuit with the LED and a brightness control and/or switch are all attached to and carried by the tube or telescope. Thus, each sighting tube or telescope comes equipped with the LED, battery and brightness control and/or switch.

Where a telescope is included, the light from the LED is focused by the tilted lens/mirror on the same image plane as the target view so that the user sees the target view and the luminous dot all in focus at the same plane with the luminous dot precisely at the center of the target view. The LED is enclosed within the telescope and the dot appears to the user the same size, shape and color for all target views, at the center of the target view, whether the target is far or near (long or short range elevation) and whether there is any adjustment for windage, left or right.

Such a luminous dot sighting instrument including a telescope is described in: my U.S. Pat. No. 5,205,044, issued Apr. 27, 1993, entitled Luminous Dot Sighting Instrument; and in my co-pending U.S. patent applications Ser. No. 07/981,012, filed Nov. 24, 1992, entitled: Reflex Luminous Dot Sighting Instrument With Undesired Dot Light Blocking; and Serial Number (unknown), filed Nov. 19, 1993, entitled Reflex Luminous Dot Sighting Instrument With Dot Light Aperture.

Elevation and windage adjustment controls are provided on all embodiments described in my above mentioned U.S. Patent and co-pending U.S. Patent Applications. In some, the adjustment requires a tool like a screwdriver and in others that have a thumb wheel projecting from the instrument and do not require a tool, the thumb wheel turns a screw that pushes against the sighting tube on a spring mount so that: adjustment in one direction is accomplished by turning the wheel clockwise to push against the tube; and adjustment in the opposite direction is accomplished by turning the wheel counterclockwise, allowing the spring mount to move the tube in the opposite direction. Thus, the control is not so connected to the tube that it can push and pull the tube; it can only push the tube and depends on the spring for adjustment in the opposite direction.

In all of these embodiments the elevation and windage adjustment controls are located for right hand use while the user is sighting the rifle and left hand use is awkward.

Heretofore, where elevation and windage adjustment controls have been provided having push and pull connection to the sighting tube, and so do not depend on a spring return force, the pushing and pulling has been done by a rigid connection to the tube, which does not allow the end of the tube that is pushed/pulled by the control to move along an arcuate path; it can only move along a straight path. This can cause the control to bind unless the angle of elevation or windage adjustment is very small and the control parts fit loosely.

SUMMARY OF THE INVENTION

It is an object of the present invention to provide a reflex luminous dot sighting instrument having elevation and windage (azimuth) adjustment controls wherein the above mentioned limitations of prior elevation and windage adjustment controls are avoided.

It is an object of the present invention to provide a reflex luminous dot sighting instrument having elevation and windage adjustment controls wherein the controls are readily manipulated by the user without a tool.

It is an object of the present invention to provide a reflex luminous dot sighting instrument having elevation and windage adjustment controls wherein the controls are readily adjusted by the user using his fingers.

It is an object of the present invention to provide a reflex luminous dot sighting instrument having elevation and windage adjustment controls wherein the controls are recessed into the instrument and project therefrom only sufficiently to be reached by the user for manual manipulation.

It is an object of the present invention to provide a reflex luminous dot sighting instrument having elevation and windage adjustment controls wherein the controls are readily adjusted by the user with either hand while sighting the instrument.

It is an object of the present invention to provide a reflex luminous dot sighting instrument having elevation and windage adjustment controls wherein the controls allow the end of the tube that is pushed/pulled by the control to move along an arcuate path and so avoid binding.

According to the present invention, a reflex luminous dot sighting instrument includes a sighting tube containing a tilted window/mirror having a coating for reflecting the luminous dot light and an LED source of luminous dot light, mounted on a base, which is attached to a rifle for sighting the rifle by the user with his eye positioned along the optical axis of the instrument. Elevation and windage adjustment controls rotate the tube with respect to the rifle about axes transverse to the rifle, one horizontal at the front of the instrument for elevation adjustment and the other vertical at the rear of the instrument for windage adjustment, the elevation adjustment control being at the rear of the instrument and the windage adjustment control being at the front of the instrument. In a first embodiment, both controls: are carried by the base and are manipulated readily by finger without a tool; are recessed substantially into the body of the base; and are readily accessible by the user's right or left hand, while the user is sighting the rifle.

A novel configuration of this first embodiment is achieved by separating the LED battery, brightness control and switch from the LED and sighting tube and carrying them in the base.

A second embodiment includes all of the features of the first embodiment and, in addition, the elevation and windage adjustment controls allow the end of the tube that is pushed/pulled by the control to move along an arcuate path and so avoid binding.

Other objects of the invention and features are apparent to those skilled in the art from the following description of the embodiments taken in conjunction with the figures.

DESCRIPTION OF EMBODIMENTS OF THE INVENTION

Embodiments of the present invention have in common that they are reflex luminous dot sighting instruments including a sighting tube carried on a base that is attached to a rifle (or other device to be sighted) in which the luminous dot source is an LED inside the tube with the tilted window/mirror and an elevation adjustment thumb wheel at the rear of the instrument and a windage adjustment thumb wheel at the front both mounted to the base are readily operated without a tool.

First Embodiment

Manual Elevation and Windage Controls

Figures 1, 2, 3, 6:
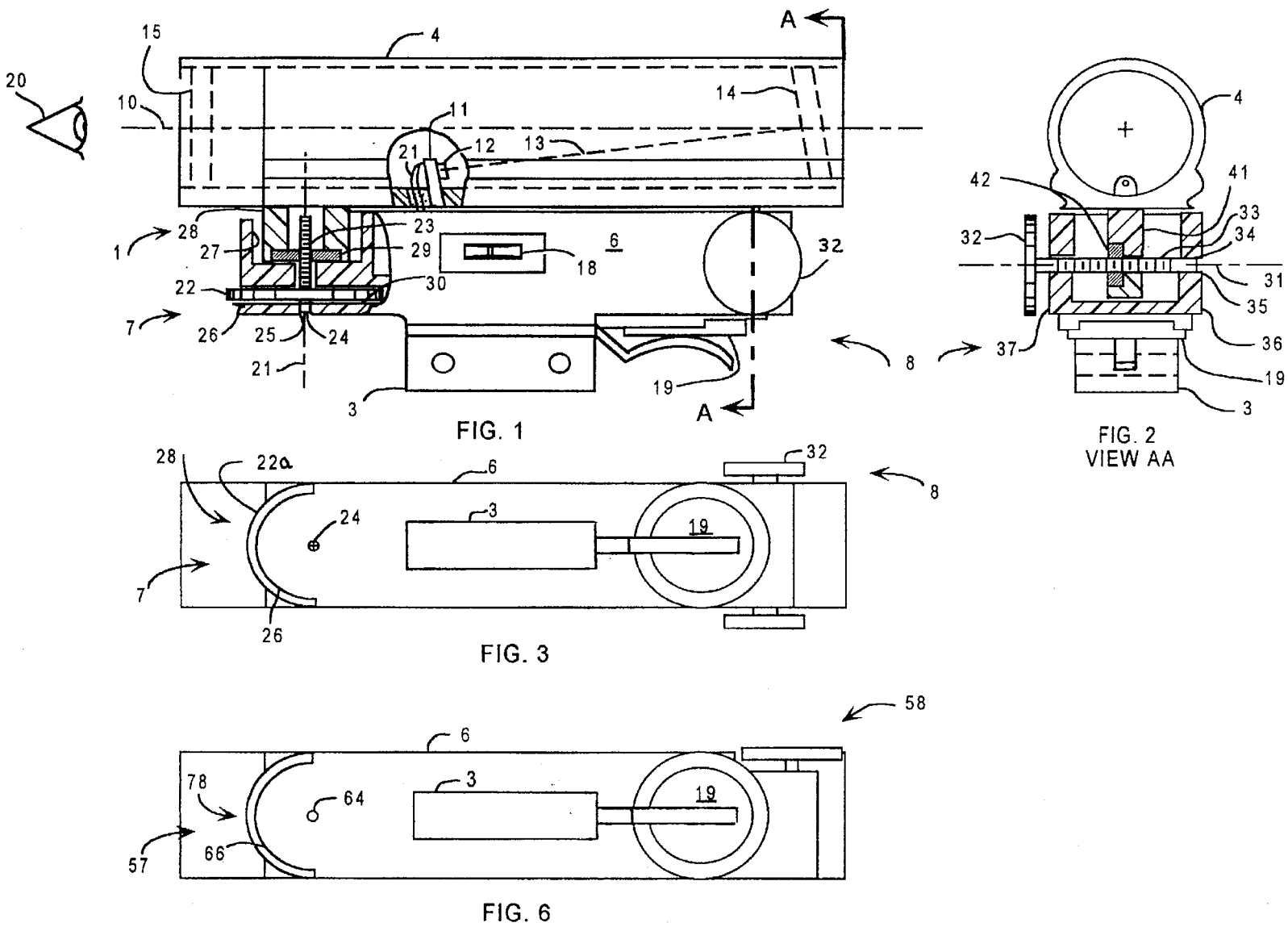
FIG. 1 is a side partially cross-section view of a reflex luminous dot sighting instrument assembly according to the first embodiment of the invention showing the instrument sighting tube and base for mounting to a rifle, an LED pedestal containing the LED inside the tube elevation and windage adjustment controls at the rear and front, respectively, of the instrument.
FIG. 2 is end partially cross-section view AA of the assembly of FIG. 1, showing the windage adjustment control at the front of the instrument.
FIG. 3 is a bottom view of the instrument in which there are left side and right side windage adjustment control thumb wheels.
FIG. 6 is a bottom view of the second embodiment of FIG. 5 in which there is a recessed right side windage adjustment control thumb wheel.

Turning first to FIGS. 1 and 2, there is shown the complete instrument assembly 1 for mounting to a rifle. The sighting instrument includes the sighting tube 4 defining the tube optical axis 10 and carried by and positioned with respect to base 6, which is attached to a rifle (not shown) by boss 3 so that the assembly stands with the sighting tube axis 10 at the desired position above the rifle barrel and generally parallel thereto except for elevation and windage adjustments.

The tube position on the base is variable in elevation and azimuth (for windage) and so varying the elevation and windage adjustment settings for the tube with respect to the base, varies the elevation and windage of the sighting tube with respect to the rifle barrel. For this purpose elevation and windage adjustment assemblies 7 and 8 are provided.

Inside tube 4 LED pedestal 11 is mounted to the inside of the tube at the bottom thereof. It contains the LED glass envelope in which the LED is held between electrodes. Immediately in front of the LED glass envelope attached to the pedestal is contoured aperture piece 12, which defines the luminous dot light path 13 that intercepts a fixed point at the center of tilted window/mirror 14, which is fixed to the inside of tube 4 at the front thereof. Fixing all of these, properly aligned is done readily as disclosed in my above-mentioned co-pending U.S. Patent Applications. Thus, the LED pedestal, tilted window/mirror and tube form a rigid assembly with the LED class envelope embedded inside the pedestal. Thereafter, this rigid tube assembly is mounted to base 6 so that it pivots up and down (elevation adjustment) about the axis of windage control assembly 8 and pivots left and right (windage adjustment) about the axis of elevation control assembly 7.

As a result, the user at 20 sees the target scene through the sighting tube, looking through plane window 15, with the luminous dot at the center of the target scene and when the windage and elevation is properly set the rifle projectile will hit the target point marked by the luminous dot.

The On-Off switch 18 for the LED is mounted for convenient access on the right side of base 6 and the battery 19 and LED brightness control circuits (not shown) inside the base are all fixed to the base. Suitable flexible electric leads 21 from these circuits to the LED electrodes in the glass envelope in the pedestal mounted inside the tube are provided.

First Embodiment

Elevation Thumb Wheel Control

Elevation control assembly 7 includes parts carried by base 6 and parts carried by tube 4 that engage by a screw thread along axis 21. The thumb wheel 22, screw 23 and axle 24 is a unitary piece mounted by axle 24 to accommodating bearing 25 in the bottom wall 26 of base 6. Tube elevation post 28 projects from the bottom of the tube slidably into cavity 27 in the base and contains, fixed thereto, nut 29, which is engaged by screw 23

Thumb wheel 22 fits rotatably in slot 30 and so is recessed into base 6 so that about half of its perimeter 22*a* is fully exposed and there is ready access to turn the thumb wheel by the user with either hand while sighting the rifle in a conventional way. As shown in FIG. 3, thumb wheel 22 is at the center rear of the base and can be accessed for manipulation from the rear or from the side by either hand. Also, it projects from the base just enough for manipulation, but not so much as to be in the way.

First Embodiment

Windage Thumb Wheel Control

Windage control assembly 8 includes parts carried by base 6 and parts carried by tube 4 that engage by a screw thread along axis 31. The thumb wheel 32, screw 33 and axle 34 is a unitary piece mounted by axle 34 to accommodating bearing 35 in the left side wall 36 of base 6. Tube windage post 41 projects from the bottom of the tube into the base and contains, fixed thereto, nut 42, which is engaged by screw 33.

Windage thumb wheel 32 is mounted along right side wall 37 of base 6, fully exposed on the right side of the instrument and so the user has ready access thereto with his right hand while sighting the rifle in a conventional way.

Second Embodiment

Flexible Elevation and Windage Controls

Figure 5:
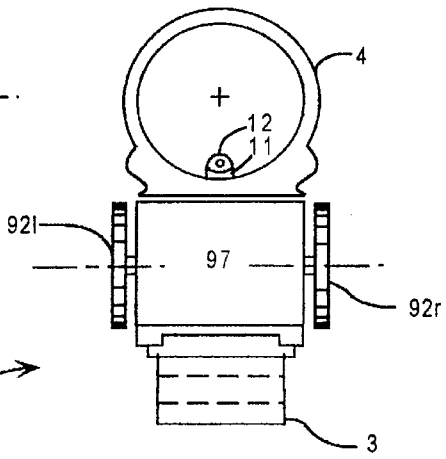
FIG. 5 is the front end view of the second embodiment of FIG. 5, showing the windage adjustment control at the front of the instrument.
Figure 4:
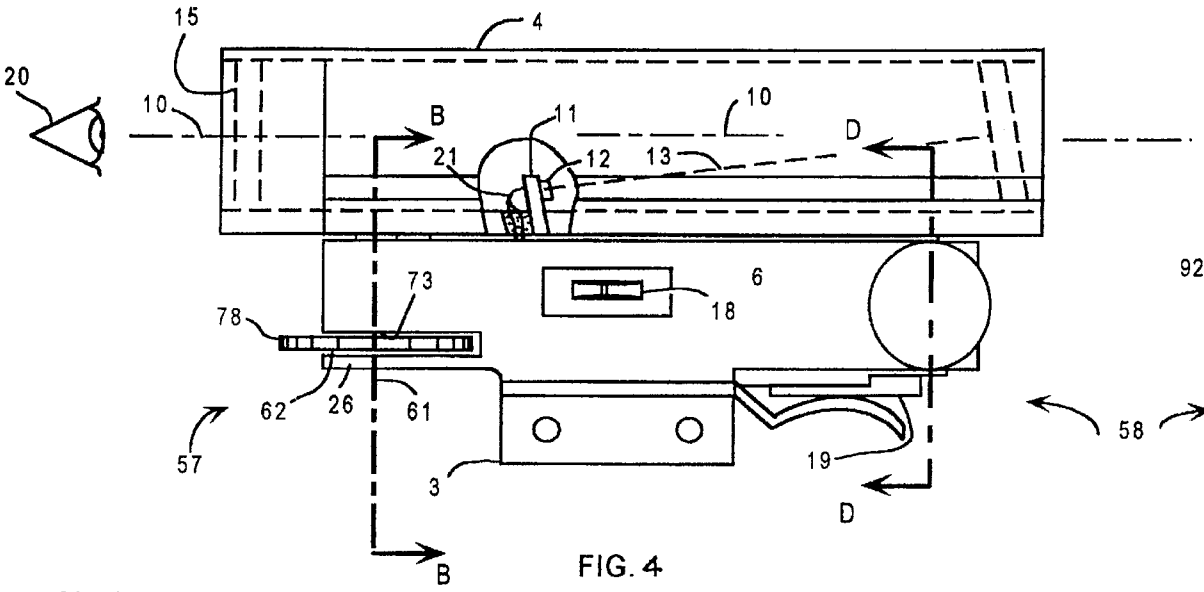
FIG. 4 is a side view of the second embodiment that includes recessed elevation and windage adjustment control thumb wheels, having, as shown further by FIGS. 7 to 10, means that allows the end of the tube that is pushed/pulled by the control to move along an arcuate path and so avoid binding.

FIGS. 4, 5 and 6 are side front and bottom views of essentially the same reflex luminous dot sighting instrument as shown in FIGS. 1, 2 and 3. Parts in this second embodiment that are the same as parts in the first embodiment bear the same reference numbers.

The elevation control assembly 57 and the windage control assembly 58 operate by turning a screw to push or pull the sighting tube, just as in the first embodiment. However, in this second embodiment the push or pull action allows arcuate movement of the respective end of the tube with reference to the base. This is done by a flexible connection (a pivoting link) from the translational moving part moved by the thumb wheel screw to the tube.

Second Embodiment

Flexible Elevation Control

Figure 7:
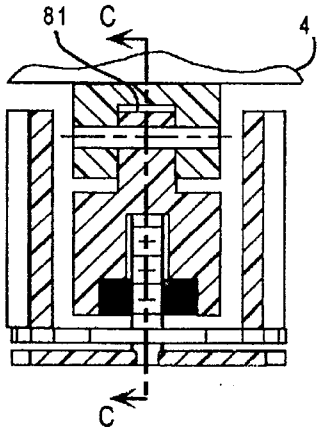
FIG. 7 is an enlarged cross section view of section BB of the instrument of FIG. 5.
Figure 8:
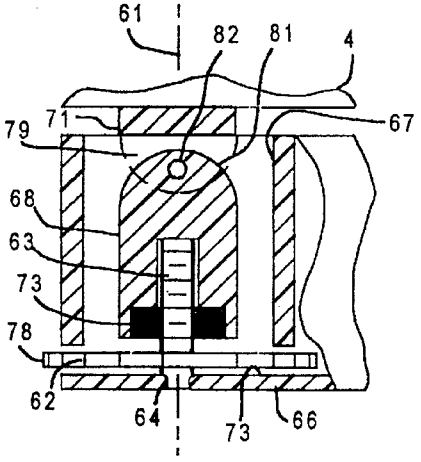
FIG. 8 is an enlarged cross section view of section CC of the instrument of FIG. 5.

The elevation assembly 57 is shown enlarged to reveal details by FIGS. 7 and 8. It includes parts carried by base 6 and parts carried by tube 4 that engage by a screw thread along axis 61. The thumb wheel 62, screw 63 and axle 64 is a unitary piece mounted by axle 64 to accommodating bearing 65 in the bottom wall 66 of base 6. Tube elevation post 71 projects from the bottom if the tube slidably into cavity 67 in the base and is pivotally connected to elevation post pivotal link connector 68. This pivotal connector link is provided by the bifurcated part 79 of post 71 into which the projection 81 of connector 68 projects and is rotatably pinned thereto by pin 82. Nut 72 is fixed to connector 68 and is engaged by screw 63.

Thumb wheel 62 fits rotatably in slot 73 and so is recessed into base 6 so that about half of its perimeter 78 is fully exposed and there is ready access to turn the thumb wheel by the user with either hand while sighting the rifle in a conventional way. As shown in FIG. 7, thumb wheel 62 is at the center rear of the base and can be accessed for manipulation from the rear or from the side by either hand. Also, it projects from the base just enough for manipulation, but not so much as to be in the way.

Second Embodiment

Flexible Windage Control

Figure 10:
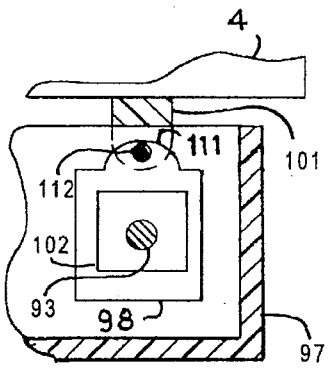
FIG. 10 is an enlarged cross section view of section EE of the instrument of FIG. 5.
Figure 9:
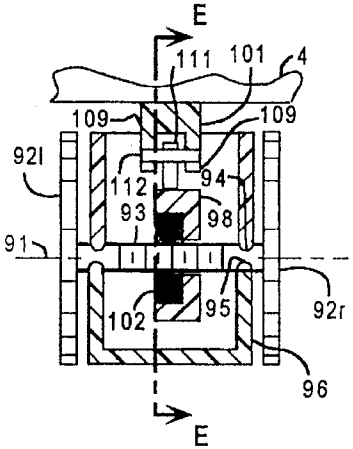
FIG. 9 is an enlarged cross section view of section DD of the instrument of FIG. 5.

The windage control assembly 58 is shown enlarged to reveal details by FIGS. 9 and 10. It includes parts carried by base 6 and parts carried by tube 4 that engage by a screw thread along axis 91. The left and right thumb wheels 921 and 92*r*, screw 93 and axle 94 is a rigid piece mounted by axle 94 to accommodating bearing 95 in the side wall 96 of base 6. Tube windage post 101 projects from the bottom of the tube into the base 6 and is pivotally connected to windage post pivotal link connector 98. This pivotal connector link is provided by the bifurcated part 109 of post 101 into which the projection 111 of connector 98 projects and is rotatably pinned thereto by pin 112. Nut 102 is fixed to connector 98 and is engaged by screw 93.

Thumb wheel wheels 921 and 92*r* are recessed into the left side, right side, respectively, of base 6 so that they project beyond either of those right side front 97 of the base. Thus, there is ready access to turn the thumb wheels by the user, particularly with his right hand, and also with his left hand while sighting the rifle in a conventional way. As shown in FIG. 9, windage thumb wheel 92*r* is at the right front side of the base (as viewed by the user) and can be accessed most readily with the right hand and the portion projecting forward from the base can be accessed by the left hand. Thus, either wheel 921 or 92*r* can be manipulated by either hand, but is not so prominent as to be in the way.

SUMMARY

While the invention described herein is described in connection with several embodiments, it will be understood that it is not intended to limit the invention to those embodiments. It is intended to cover all alternatives, modifications, equivalents and variations of those embodiments and their features as may be made by those skilled in the art within the spirit and scope of the invention as defined by the appended claims.

I claim:

1. A sighting instrument for sighting a rifle on a target, including a sighting tube having a front end and a rear end and defining an optical axis, an aperture at said front end of said tube for admitting light from a target view along said optical axis, whereby said target view is visible by looking into said rear end of said tube along said optical axis comprising, (a) a base attached to said rifle, (b) elevation and windage adjustment controls on said base that connect to said tube and rotate said tube with respect to said rifle about axes transverse to the rifle, one horizontal at the front of said tube for elevation adjustment and the other vertical at the rear of said tube for windage adjustment, (c) said elevation adjustment control being at the rear of said tube and said windage adjustment control being at the front of said tube, (d) said elevation adjustment control includes:

(e) an elevation adjustment control screw and thumb wheel rotatably mounted to said base and (f) an elevation adjustment control screw follower flexibly connected to said tube and driven by said elevation adjustment control screw, (g) whereby, rotation of said elevation adjustment control thumb wheel in one direction pushes said rear end of said tube away from said base and rotation of said thumb wheel in the opposite direction pulls said rear end of said tube toward said base and the motion path of said rear end of said tube when so pushed or pulled is arcuate.

2. A sighting instrument as in claim 1, wherein, (a) said elevation adjustment control thumb wheel is substantially recessed into said base so as to be readily accesible and out of the way.

3. A sighting instrument as in claim 1, wherein, (a) said elevation adjustment control screw follower includes an elevation adjustment link pivotally connected to said tube and a nut captured by said elevation adjustment control link and threadably engaged by said screw.

4. A sighting instrument as in claim 3, wherein, (a) an elevation adjustment control sleeve is provided in said base and said elevation adjustment control link fits slidably into said sleeve.

5. A sighting instrument for sighting a rifle on a target, including a sighting tube having a front end and a rear end and defining an optical axis, an aperture at said front end of said tube for admitting light from a target view along said optical axis, whereby said target view is visible by looking into said rear end of said tube along said optical axis comprising, (a) a base attached to said rifle, (b) elevation and windage adjustment controls on said base that connect to said tube and rotate said tube with respect to said rifle about axes transverse to the rifle, one horizontal at the front of said tube for elevation adjustment and the other vertical at the rear of said tube for windage adjustment, (c) said elevation adjustment control being at the rear of said tube and said windage adjustment control being at the front of said tube, (d) said windage adjustment control includes:

(e) a windage adjustment control screw and thumb wheel rotatably mounted to said base and (f) a windage adjustment control screw follower flexibly connected to said tube and driven by said windage adjustment control screw, (g) whereby, rotation of said windage adjustment control thumb wheel in one direction pushes said front end of said tube one lateral direction and rotation of said thumb wheel in the opposite direction pulls said front end of said tube in the opposite lateral direction and the motion path of said front end of said tube when so pushed or pulled is arcuate.

6. A sighting instrument as in claim 1, wherein, (a) said windage adjustment control thumb wheel is substantially recessed into said base side so as to be readily accessible and out of the way.

7. A sighting instrument as in claim 1, wherein, (a) said windage adjustment control screw has a thumb wheel at each end thereof, one on the right and one on the left side of said base and substantially recessed into said base so as to be readily accessible from either side of said base.

8. A sighting instrument as in claim 6, wherein, (a) said windage adjustment control screw follower includes a windage adjustment control link pivotally connected to said tube and a nut captured by said windage adjustment control link threadably engaged by said screw.

* * * * *